United States Patent [19]

Okada

[11] 4,430,811

[45] Feb. 14, 1984

[54] FOOTWEAR

[75] Inventor: Hozuma Okada, Kyoto, Japan

[73] Assignee: Sakashita Co., Ltd., Kyoto, Japan

[21] Appl. No.: 336,591

[22] Filed: Jan. 4, 1982

[30] Foreign Application Priority Data

Sep. 30, 1981 [JP] Japan ..... 56-146393[U]

[51] Int. Cl.[3] ..... A43B 23/00; A43B 13/14; A43B 13/38

[52] U.S. Cl. ..... 36/45; 36/30 R; 36/44

[58] Field of Search ..... 36/45, 46.5, 47, 30 R, 36/44

[56] References Cited

U.S. PATENT DOCUMENTS

| | | | |
|---|---|---|---|
| 3,568,339 | 3/1971 | Hara et al. | 36/45 |
| 3,583,081 | 6/1971 | Hayashi | 36/45 |
| 3,968,292 | 7/1976 | Pearman et al. | 36/45 |

*Primary Examiner*—Patrick D. Lawson

*Attorney, Agent, or Firm*—Wenderoth, Lind & Ponack

[57] ABSTRACT

A footwear such as shoes, boots, slippers etc., comprises a three-layered structure including an outer cover, an intermediate layer made of foamed urethane and an inner cover.

The inner cover has a double-layered structure including first and second layer of fabric and the first and second layer are so combined as not only to show good absorption of the sweat emitted from the wearer's foot but also to keep the surface thereof held in contact to the foot dry.

7 Claims, 6 Drawing Figures

FOOTWEAR

BACKGROUND OF THE INVENTION

The present invention relates to footwear such as shoes, boots, slippers or sandals and, more particularly, to an improvement in the inner cover used in the footwear to contact the foot of a wearer when the footwear is in use.

There have been placed on the market footwear such as sport shoes or ski boots. An example of the prior art footwear is shown in FIG. 1, and is provided with an intermediate layer 1 made of foamed urethane and positioned between an outer cover 2, defining the outer surface of the footwear including the sole thereof, and an inner cover 3 held in position to contact the foot of the wearer when the footwear is in use. As a material for the inner cover 3, there has been used a tricot knit nylon fabric having a relatively high moisture holding capability compared with other synthetic fabrics.

The structure of this type has some advantages in that it can improve the adaptation to the wearer's foot and that it can provide an adiabatic structure with respect to the wearer's foot.

On the contrary to the above, the inner cover of the footwear absorbs the sweat discharged from the wearer's foot during the use thereof. However, since the skin of the wearer's foot is held in contact, directly or indirectly through the stocking, with the inner cover having absorbed much sweat, the skin becomes wet and gets steamed by the heat of the wearer's foot. This adversely affects the wearing comfortability to the wearer.

SUMMARY OF THE INVENTION

One object of the present invention is to provide a footwear which is effective not only to absorb much sweat, but also to keep the surface of the inner cover always dry and, accordingly, is comfortable for the wearer to wear without causing it to be steamed.

Another object of the present invention is to provide a footwear of the type referred to above which has a double-layer structure fitted to the inner cover of the footwear. The double-layered structure comprises first and second layers of fabric combined together, with first layer of fabric being always dry even though it may be in direct contact with the wearer's foot, and said second layer of fabric being effective to absorb much moisture which penetrates through said first layer of fabric.

Footwear according to the present invention generally has a three-layered structure comprising an intermediate layer made of foamed urethane and having first and second opposite surfaces, an outer cover bonded to the first surface of the intermediate layer and so shaped as to cover at least a portion of the foot of a wearer, and an inner cover bonded to the second surface of the intermediate layer and held in position to contact the wearer's foot when the footwear is in use. The footwear of the present invention is featured in that the inner cover itself has a double-layered structure comprising first and second layers of fabric combined together. The fabric of said first layer has a relatively high moisture permeability and a relatively low moisture holding capability whereas the fabric of said second layer has a relatively high moisture holding capability.

BRIEF DESCRIPTION OF THE DRAWINGS

These and other objects and features of the present invention will become apparent from the following description taken in connection with a preferred embodiment thereof with reference to the accompanying drawings, wherein.

DETAILED DESCRIPTION OF THE INVENTION

Figure 1:
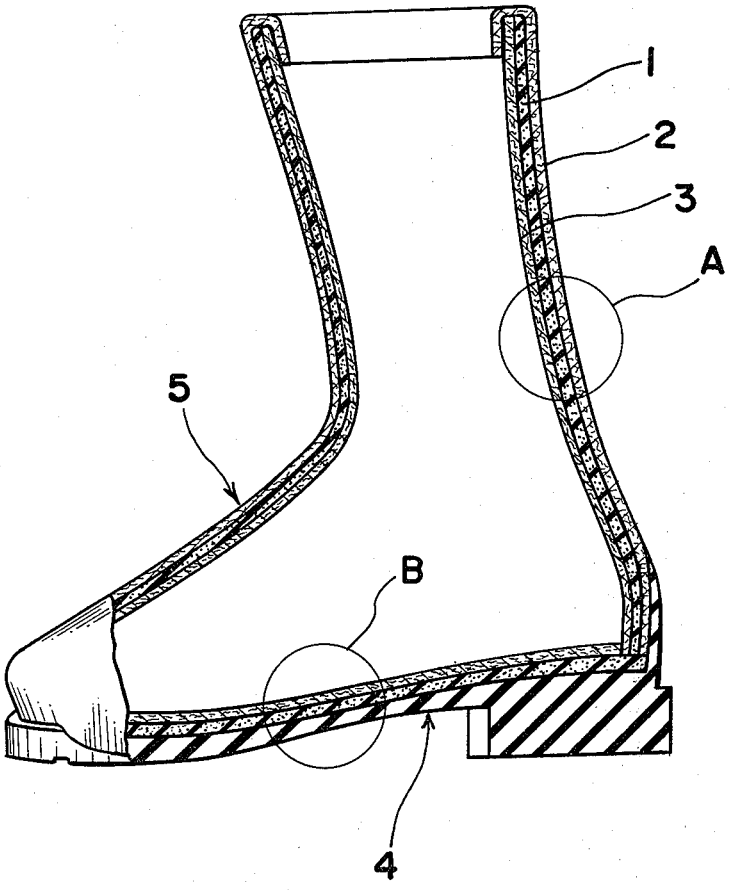
FIG. 1 is a schematical sectional view showing a boot as an example of footwear.

Footwear so far shown in FIG. 1 is a boot and is comprised of a sole portion 4 and an upper portion 5 covering at least a portion of the instep and the heal of the wearer's foot as shown in FIG. 1.

Figure 2:
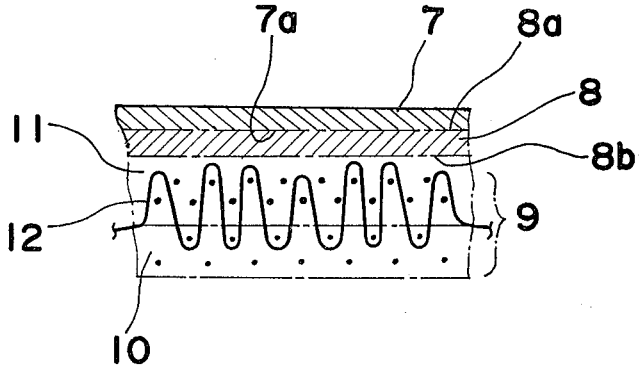
FIG. 2 is a schematical sectional view, on an enlarged scale, showing a portion shown by A in FIG. 1.

According to the present invention, as shown in FIG. 2, the upper portion 5 of the footwear is formed with a three-layered structure substantially comprised of an outer cover 7, an intermediate layer 8, made of foamed urethane, and an inner cover 9.

The outer cover 7 defines an outer surface of said upper portion 5 and is made of a material such as fabric, leather, synthetic leather, rubber, synthetic rubber, known to those skilled in the art.

The intermediate urethane layer 8 has such a property that it is able to permeate gases, but not liquids therethrough under an ordinary condition during the use of the footwear, and also a relatively high thermal capacity and a good cushioning property. The first surface **8*a* of the intermediate urethane layer 8 and the inner surface 7*a* of the outer cover 7** are bonded together by a method known to those skilled in the art.

The inner cover 9 has a double-layered structure comprising first and second layers 10, 11 of fabric joined together with threads. The first layer 10 is adapted to contact the wearer's foot directly or indirectly through the stocking whereas the second layer 11 joined to said first layer 10 is bonded to the second surface **8*b* of the intermediate layer 8** by a method known to those skilled in the art.

It is desirable to use, as said inner cover 9, a double knitted fabric knitted by a Russel tricot knitting machine.

Figure 3:
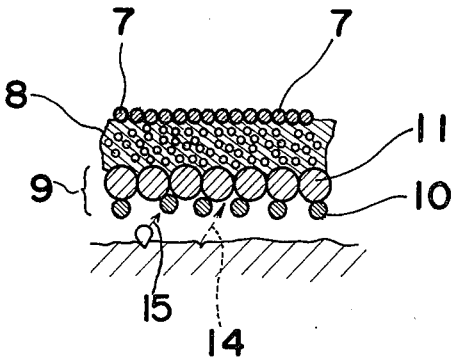
FIG. 3 is a sectional view showing a specific structure of FIG. 2 together with a portion of the skin of the wearer's foot.

As shown in FIG. 3, the knitting gauge to be used for the first knitted fabric 10 is chosen to a smaller value than that of the second knitted fabric 11 in order to increase the moisture permeability thereof. The knitting method for the first and second knitted fabric 10 and 11 may be either warp knitting or flat knitting.

The knitted fabric used for the first layer 10 has a relatively high moisture permeability and a relatively low moisture holding capability and may be polyvinyl chloride fabric, polyyester fabric, nylon fabric, polypropylene fabric, vinylidene fabric or vinylon fabric.

Among these synthetic fabrics, the polyvinyl chloride especially teviron fabric is most suitable for the first layer 10. The teviron fabric has a low moisture holding capability of 0.0~0.3% under the condition of room temperature of 20° C. and a relative humidity of 95% and has a high moisture permeability and a high thermal capacity. Next to the teviron fabric, the polyyester fabric is suitable because of the low moisture holding capability of 0.6~0.7% under the same condition as mentioned above. Also, nylon fabric is usable, which has a moisture holding capability of 8.0~9.0%. Although both the polyyester and nylon fabric have a relatively higher moisture holding capability than that of the polyvinyl chloride fabrics, these fabric are usable if they have relatively large meshes.

The knitted fabric used as a material for the first layer 10 has a thickness, depending on the count and the gauge of yarns used therefor which is sufficient to avoid any possible direct contact of the wearer's foot to the second layer 11 and to show a good durability without dismissing the permeability thereof. In order to satisfy these requirements, it is desirable to use the fiber prepared by the use of yarns of 30~100 denyls thereof and the gauge thereof is preferably within the range of 36~14 wales per inch depending on the count of the yarns used for said fiber.

On the contrary to the above, the second layer 11 is provided for the purpose for holding or absorbing therein moisture or sweat having been emitted from the wearer's foot and which has permeated through said first layer 10. To this end, it is desirable to use, as a material for the second layer 11, a knitted fabric having a relatively high moisture holding capability and a smaller mesh with thick fiber compared with the fabric of the first layer 10. The knitted fabric also has a thickness sufficient to hold moisture absorbed therein and not to discharge it therefrom to the first layer 10 even when a compressive pressure acts thereon through the first layer 10.

The fabric used for the second layer 11 is desirably a cupra fabric having a moisture holding capability of 21.0~25.0% under the condition of room temperature of 20° C. and of a relative humidity of 95%, a rayon fabric having a moisture holding capability of 25.0~30.0% under the same condition, a cotton fabric of 24.0~27.0% in moisture holding capability under the same condition, a hygroscopic nylon fabric or an acrylic fabric. And, it is desirable to use fabric of a thickness greater than 40 denyls for the purpose thereof. Also, as a knitting fiber used to combine both fabrics, the same fiber as the fabric of the first layer 10 is desirably used.

The inner cover 9 comprising first and second layer 10, 11 acts with respect to the moisture or the sweat discharged from the wearer's foot as follows.

As shown by an arrow 14 in FIG. 3, the moisture vapourised directly on the surface of the skin of the wearer's foot goes through the clearance defined between each adjacent fibers of the first layer 10 and is caught or absorbed by the second layer 11 in the moisture state or in the liquid state. The sweat 15 in the liquid state emitted from the wearer's foot permeates through the first layer 10 and is absorbed into the second layer 11.

A portion of the sweat absorbed in the second layer 11 is evaporated and goes through the foams continuously formed in the foamed urethane layer 8 and is, then, discharged through the outer skin 6 to the outside of the footwear. Other portion of the sweat, after evaporated, is discharged through the first layer 11 into the space between the wearer's foot and the footwear. The moisture discharged into such space is discharged out of the footwear due to the breathing action during its use.

As mentioned above, since the evaporation and condensation of the sweat are done only in the second layer 11 of the inner cover 9, the evaporative heat or the heat of condensation does not directly affect the skin of the wearer's foot separated from the second layer 11 by the intervention of the first layer 10.

One of the most suitable combinations of the first and second layer 10 and 11 is a combination wherein the first layer 10 is a fabric made of polyvinyl chloride and the second layer 11 is a fabric made of cupra, because this combination is easy in knitting, tough and cheap in cost and, moreover, it is easy to bond it to the intermediate layer 8.

However, where a vulcanization is carried out during the manufacture of the footwear such as a rubber shoes, a fabric of polyyester or nylon, etc., is to be used instead of said fabric of polyvinyl chloride, because the fabric of polyvinyl chloride has a thermoplasticity and may be deformed during the vulcanization process. When a combination of a fabric of polyyester for the first layer 10 and a fabric of cupra for the second layer 11 is employed, a fabric of 30 denyls in the count and of 34 wales per inch in the mesh thereof is desirably used as said polyyester fabric and a fabric of 50 denyls and of 34 wales per inch as said cupra fabric.

Figure 4:
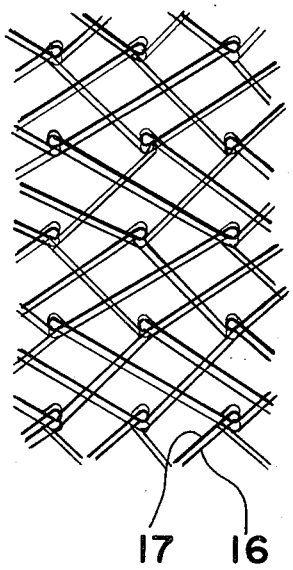
FIG. 4 is a plan view, on a further enlarged scale, of an inner cover used in the boot of FIG. 1.
Figure 5:
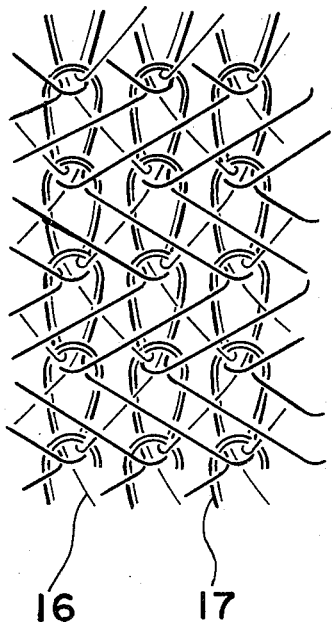
FIG. 5 is a view similar to FIG. 4, showing an alternative material for the inner cover.

As shown in FIG. 4 and FIG. 5, it is possible to use a double knitted fabric as an inner cover in which first knitting fiber 16 for the first fabric layer and second knitting fiber 17 for the second fabric layer are double knitted to combine said first and second fabric layer directly without using fibers for joining.

Figure 6:
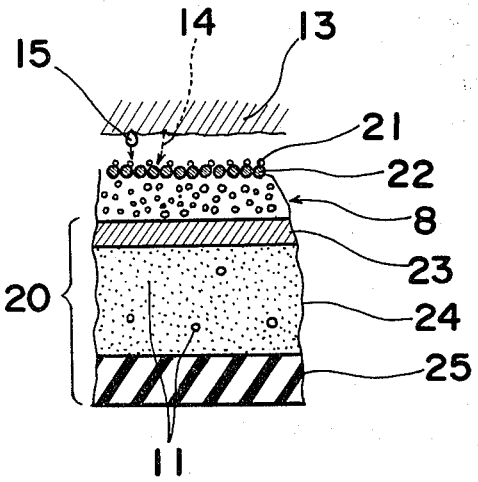
FIG. 6 is an enlarged sectional view of another portion shown by B in FIG. 1 showing a sectional structure of the sole of the footwear according to the present invention.

In FIG. 6, an enlarged sectional view of the sole portion B of FIG. 1 is shown. As shown in FIG. 6, the sole portion has also a three-layered structure comprising an inner cover (corresponding to 9 of FIG. 3), an intermediate layer 8 of foamed urethane and an outer cover 20.

As a suitable inner cover of the sole portion, a double woven fabric 21 comprises a first fabric 21 as the first layer and second fabric 22 as the second layer, because a woven fabric is more durable than a knitted fabric. The properties of each of first and second fabric are chosen substantially in the same manner as in the foregoing. However, since the inner cover of the sole portion is exposed to a higher pressure and more sweat than the other portion of the footwear, the material, the thickness of fiber and the mesh of each of first and second fabric are so chosen that these fabrics may be durable under such a hard condition.

The outer cover 20 comprises an intermediate sole 23 made of paper or synthetic resin, a hard urethane layer 24 and an outer sole 25 made of rubber.

In the structure above mentioned, the manner of absorption of the sweat emitted from the wearer's foot to the second layer 22 is substantially the same as that described with reference to FIG. 3, and the moisture absorbed is discharged out of the footwear, after evaporised, after being vaporized, by a breathing action due to the extraction and contraction of the inner cover 9 and the intermediate layer 8. It may be also possible to emit the moisture absorbed out of the footwear by using hard urethane as the intermediate layer instead of the soft urethane and by providing passages through said hard urethane for emitting said moisture therethrough to the outer surface of the footwear as a result of the breathing action. Moreover, if the footwear is leather shoes, it may be possible to emit the moisture by using a leather having a gas permeability as an outer cover 20.

The results of experiments made for testing the moisture permeability and the moisture holding capability of said inner cover are shown as follows.

[Test For Moisture Permeability]

Four testpieces (a), (b), (c) and (d) are prepared. Testpiece (a) has a single layer structure of a tricot knitted nylon fabric. Testpieces (b), (c) and (d) are double-knitted fabrics comprising a nylon, polyyester and tevilon layer as first layer, respectively, and a cupra layer as second layer. These testpiece are wetted by applying an equal amount of water thereto from the first layer and are thereafter compressed with the pressure of 0.1 kg per $cm^2$ to remove water. The amounts of water which has been contained in the first layer of each testpieces (a), (b), (c), (d) is measured by permitting said water to be absorbed on a blotting paper.

TABLE 1

| testpiece | weight before test | weight (Wo) of water applied | weight after compression | weight (W) of water contained | (W/Wo) × 100 |
|---|---|---|---|---|---|
| (a) nylon | 0.38 g | 0.22 g | 0.40 g | | 91% |
| blotting paper | 1.20 g | | 1.40 g | 0.20 g | |
| (b) nylon + cupra | 0.50 g | 0.25 g | 0.65 g | | 40% |
| blotting paper | 1.20 g | | 1.30 g | 0.10 g | |
| (c) polyester + cupra | 0.30 g | 0.25 g | 0.45 g | | 40% |
| blotting paper | 1.20 g | | 1.30 g | 0.10 g | |
| (d) teviron + cupra | 0.70 g | 0.50 g | 1.10 g | | 20% |
| blotting paper | 1.20 g | | 1.30 g | 0.10 g | |

The results of these tests are shown in Table 1. As seen clearly from Table 1, the testpieces (b), (c) and (d) according to the present invention are excellent in minimizing the steaming the wearer's foot in comparison with the testpiece (a), because the first layers thereof contain less water than the testpiece (a). And, among these test pieces (b), (c) and (d), the testpiece (d) is most favorable.

[Test for Moisture Holding Capability]

Two testpieces (e) and (f) are prepared. The testpiece (e) has a double layered structure comprising first layer of nylon fabric woven into mesh and second layer of cupra. The testpiece (e) has only one layer of nylon fabric being the same as the first layer of the testpiece (e). These testpiece (e) and (f) are wetted by contacting a sponge member containing an equal amount of water with the nylon layer thereof under the same pressure and, thereafter, the weight of water contained in the nylon layer of testpiece (e) and (f) are measured by weighing.

The results are shown in Table II

TABLE 2

| Testpiece | weight before Test | weight after Test | weight of water absorbed | |
|---|---|---|---|---|
| (f) nylon | 4.9 g | 5.7 g | 0.8 g | |
| (e) nylon + | 4.9 g | 5.3 g | 0.4 g | 1.3 g |

TABLE 2-continued

| Testpiece | weight before Test | weight after Test | weight of water absorbed |
|---|---|---|---|
| cupra | 1.2 g | 2.1 g | 0.9 g |

As seen from Table 2, the testpiece (e) according to the present invention has a higher water absorption capability compared with the single layered testpiece (f). It is to be noted that the nylon layer of the double-layered testpiece (e) absorbs less water than that by the single layered nylon testpiece (f). According to these results, it is also clear that the inner cover of double layered structure according to the present invention is excellent in absorbing the sweat emitted from the wearer's foot.

What is claimed is:

1. Footwear comprising;

an intermediate layer made of foamed urethane and having first and second opposite surfaces;

an outer cover bonded to the first surface of the intermediate layer and so shaped as to cover at least a portion of the foot of a wearer; and an inner cover bonded to the second surface of the intermediate layer and held in position to contact the foot of the wearer when the footwear is in use;

said inner cover being of a double-layered structure including first and second layers of fabric joined together, the first layer being a woven or knitted fabric and adapted to contact the wearer's foot and the second layer being bonded to the intermediate layer, the fabric of said first layer having a relatively high moisture permeability and a relatively low moisture holding capability whereas the fabric of said second layer has a relatively high moisture holding capability.

2. Footwear according to claim 1, wherein said fabric of the second layer is a woven fabric or a knitted fabric.

3. Footwear according to claim 1, wherein said fabric of the first layer is made of a synthetic material selected from the group consisting of polyvinyl chloride, polyyester, nylon, polypropylene, vinylidene and vinylon.

4. Footwear according to claim 1, wherein said fabric of the second layer is made of a material selected from the group consisting of cupra, rayon, cotton, nylon, and acrylic.

5. Footwear according to claim 1, wherein said fabric of the first layer has meshes larger than that of said fabric of the second layer.

6. Footwear according to claim 1, wherein said fabric of the first layer is prepared from yarns having 30~100 denyl and has 14~50 wales per inch.

7. Footwear according to claim 1, wherein the yarn for the fabric of the second layer is larger than 40 denyl.

* * * * *